US008414106B2

(12) United States Patent
Walker et al.

(10) Patent No.: US 8,414,106 B2
(45) Date of Patent: Apr. 9, 2013

(54) PRINTER FLUID CHANGE MANIFOLD

(75) Inventors: Casey E. Walker, Boulder, CO (US); Scott R. Johnson, Erie, CO (US); Stuart J. Boland, Denver, CO (US)

(73) Assignee: InfoPrint Solutions Company LLC, Boulder, CO (US)

( * ) Notice: Subject to any disclaimer, the term of this patent is extended or adjusted under 35 U.S.C. 154(b) by 113 days.

(21) Appl. No.: 12/959,071

(22) Filed: Dec. 2, 2010

(65) Prior Publication Data

US 2012/0139995 A1 Jun. 7, 2012

(51) Int. Cl.
*B41J 2/15* (2006.01)
*B41J 2/145* (2006.01)

(52) U.S. Cl.
USPC ..... 347/40; 347/89

(58) Field of Classification Search ..... 347/22, 347/29, 30, 36, 40, 43, 84–86, 89–92
See application file for complete search history.

(56) References Cited

U.S. PATENT DOCUMENTS

| | | | | |
|---|---|---|---|---|
| 6,241,347 | B1 | 6/2001 | Becker et al. | |
| 6,609,778 | B2 | 8/2003 | Ingham et al. | |
| 7,350,897 | B2 | 4/2008 | Ciliberti et al. | |
| 7,832,836 | B2 * | 11/2010 | Iwasaki et al. | 347/40 |
| 7,878,639 | B2 * | 2/2011 | Silverbrook et al. | 347/92 |
| 2007/0139465 | A1 | 6/2007 | Nakashima | |
| 2007/0263020 | A1 | 11/2007 | Bradford et al. | |
| 2008/0204533 | A1 | 8/2008 | Nathan et al. | |
| 2009/0027449 | A1 | 1/2009 | Silva et al. | |
| 2009/0040249 | A1 | 2/2009 | Wouters et al. | |
| 2011/0080456 | A1 * | 4/2011 | Shibata et al. | 347/92 |

FOREIGN PATENT DOCUMENTS

JP 2007-69419 A * 3/2007

* cited by examiner

*Primary Examiner* — Thinh Nguyen
(74) *Attorney, Agent, or Firm* — Blakely, Sokoloff, Taylor & Zafman LLP

(57) ABSTRACT

A system is disclosed. The system includes a print engine having one or more ink jet print heads and ink lines coupled to provide ink to each of the print heads. The system also includes a fluid change manifold coupled to the ink lines to remove fluid from the print engine via the ink lines.

19 Claims, 5 Drawing Sheets

PRINTER FLUID CHANGE MANIFOLD

FIELD OF THE INVENTION

This invention relates generally to the field of ink jet printing systems. More particularly, the invention relates to maintaining a print engine within an ink jet printing system.

BACKGROUND

An ink jet printer is an example of a printing apparatus that ejects droplets of ink onto a recording medium, such as a sheet of paper, for printing an image on the recording medium. The ink jet printer includes a print engine having one or more ink jet print heads provided with an ink cartridge that accommodates the ink. In operation of the print engine, the ink is supplied from the ink cartridge to each ink jet print head having ejection nozzles, so that a printing operation is performed by ejection of the ink droplets from selected ejection nozzles.

Often it may be necessary to change the ink or other fluids within a print engine during normal cleaning and maintenance. Alternatively, a printer user may wish to replace an ink color, or replace a color with a different or incompatible type of ink (e.g., magnetic ink character recognition (MICR)), cleaning fluid, or remove trapped air from ink lines within the print engine. However, changing inks and fluids, or removing air from a print engine may be a costly and time consuming task.

For instance, an ink change involves discarding relatively large volumes of costly ink. Moreover, removing such large volumes may result in damage to the print head from which the ink is being used because the ink is typically pulled through the print head by a maintenance station. Further, if a print head is supplied multiple colors of inks it can become difficult to remove one color ink without having to remove the other(s), especially if the different inks consist of different viscosities. Thus, all colors supplied by the print head must be removed during ink removal, resulting in the wasting of the ink that did not need to be removed.

Therefore, a mechanism to improve ink or other fluid removal from a printing system is desired.

SUMMARY

In one embodiment, a system is disclosed. The system includes a print engine having one or more ink jet print heads and ink lines coupled to provide ink to each of the print heads. The system also includes a fluid change manifold coupled to the ink lines to remove a fluid from the print engine via the ink lines.

In a further embodiment, a fluid change manifold is disclosed. The fluid change manifold includes a block having a first set of receptacles coupled to a first set of ink lines to remove a first fluid type; and a second set of receptacles coupled to a second set of ink lines to remove a second fluid type.

BRIEF DESCRIPTION OF THE DRAWINGS

A better understanding of the present invention can be obtained from the following detailed description in conjunction with the following drawings, in which.

DETAILED DESCRIPTION

A print engine fluid change manifold is described. In the following description, for the purposes of explanation, numerous specific details are set forth in order to provide a thorough understanding of the present invention. It will be apparent, however, to one skilled in the art that the present invention may be practiced without some of these specific details. In other instances, well-known structures and devices are shown in block diagram form to avoid obscuring the underlying principles of the present invention.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Figure 1:
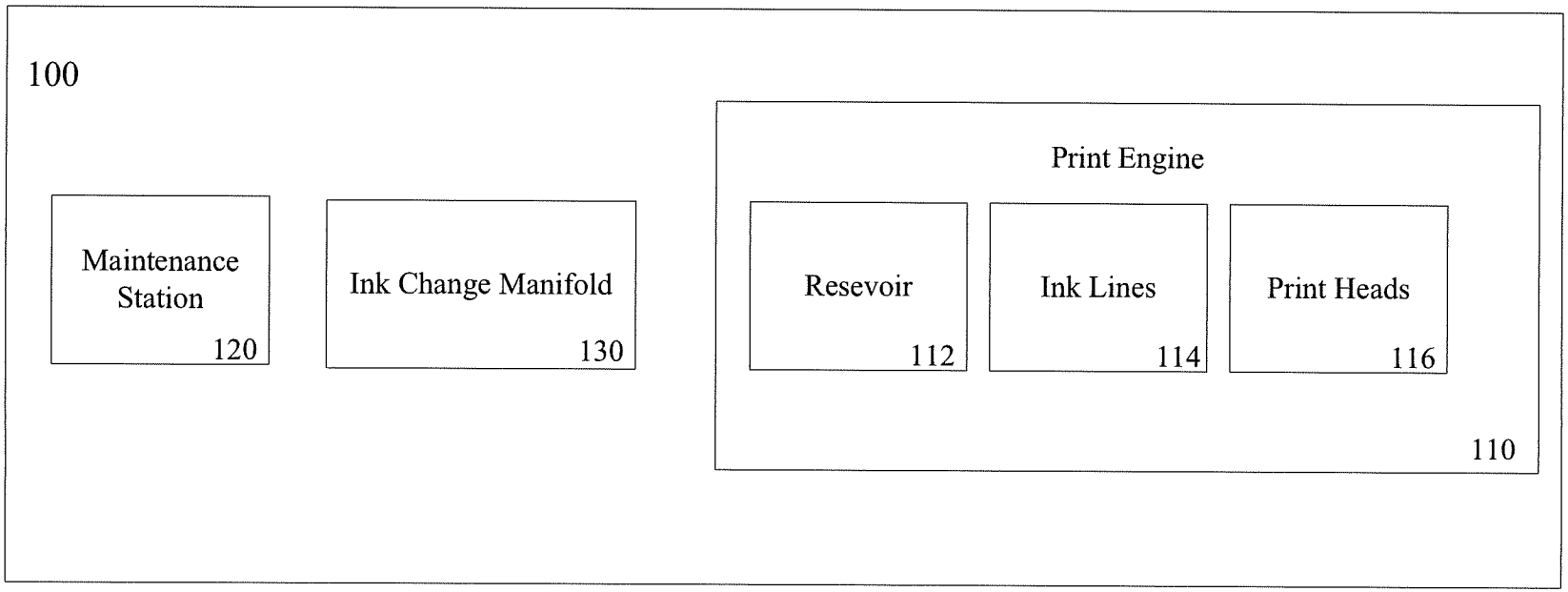
FIG. 1 illustrates one embodiment of a system.

FIG. 1 illustrates one embodiment of a system 100. System 100 includes an ink printing system 110, maintenance station 120 and fluid change manifold 130. Print engine 100 provides an imaging process to mark a printable recording medium (e.g., paper). Ink printing system 110 includes an ink reservoir 112 that provides an ink supply to print heads 116 via ink lines 114.

According to one embodiment, print heads 116 provides four color printing using forty print heads. In such an embodiment, each print head 116 is a fixed, wide-array inkjet print head including one or more nozzles (not shown) that are implemented to eject droplets of ink onto the recording medium. In a further embodiment, each print head 116 prints two ink colors, in which eight ink lines 114 (four per color) provide the ink to each print head 116. In other embodiments, print heads 116 may include configurations other than described above.

Maintenance station 120 is used to maintain print head 116 by pulling fluid from ink printing system 110 via a vacuum. According to one embodiment, maintenance station 120 is coupled to fluid change manifold 130 in order to facilitate ink removal. In such an embodiment, ink lines 114 are removed from print heads 116 and are placed on fluid change manifold 130. Subsequently, the vacuum provided by maintenance station 120 pulls the fluid from ink printing system 110 via fluid change manifold 130, rather than through print heads 116.

Figure 2:
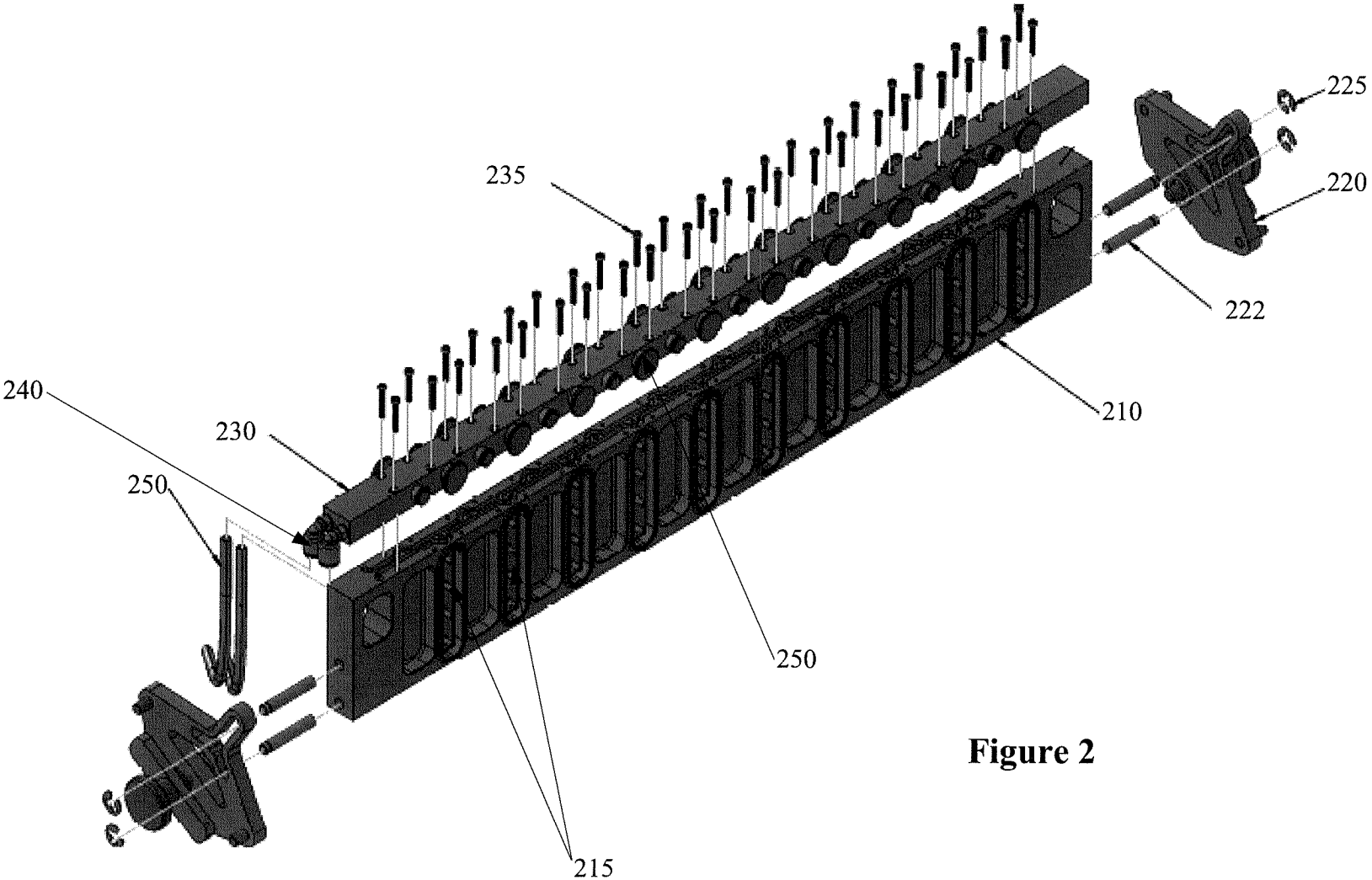
FIG. 2 illustrates one embodiment of a fluid change manifold.
Figure 3A:
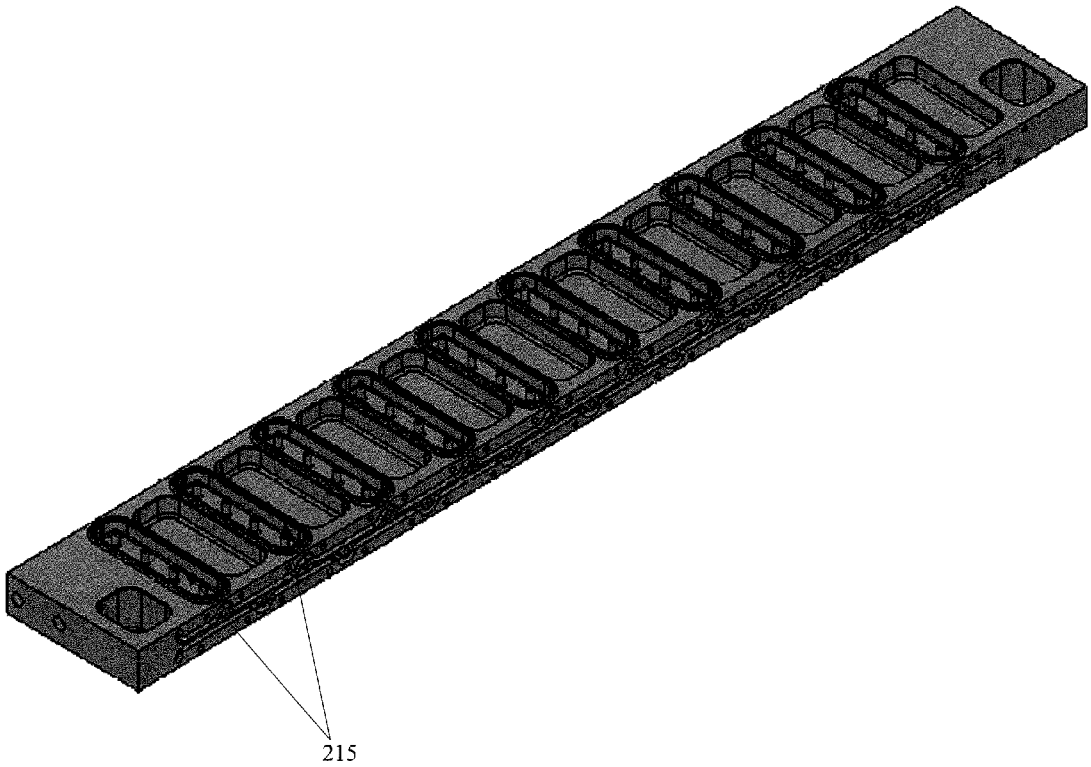
FIGS. 3A-3D illustrate embodiments of various components of a fluid change manifold.

FIG. 2 illustrates one embodiment of a fluid change manifold 130. Manifold 130 includes a manifold block 210, bracket 220 and a rack 230. Manifold block 210 includes sets of fluid receptacles 215. During fluid removal, each receptacle 215 in a set is attached to an ink line, where each receptacle 215 in the set is intended to receive the same fluid. For example, rows 1-4 may receive Cyan, Magenta, Yellow and Black inks, respectively. However in other embodiments, a single ink, or another type of ink (e.g., MICR), or other fluids may replace one or more of the colors (e.g., cyan). FIG. 3A illustrates a top view of manifold block 210.

Figure 3B:
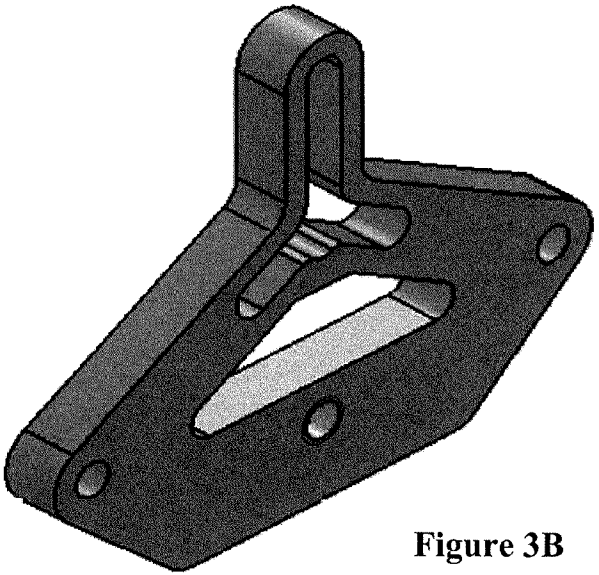

Referring back to FIG. 2, bracket 220 is coupled to block 210 via pins 222 and locking clips 225, and is implemented to attach manifold 130 to ink printing system 116. Pins 222 reside in slots located in bracket 220 and allow a restricted range of motion to manifold block 210 for positioning within ink printing system 110. FIG. 3B illustrates an isometric view of bracket 220.

Figure 3C:
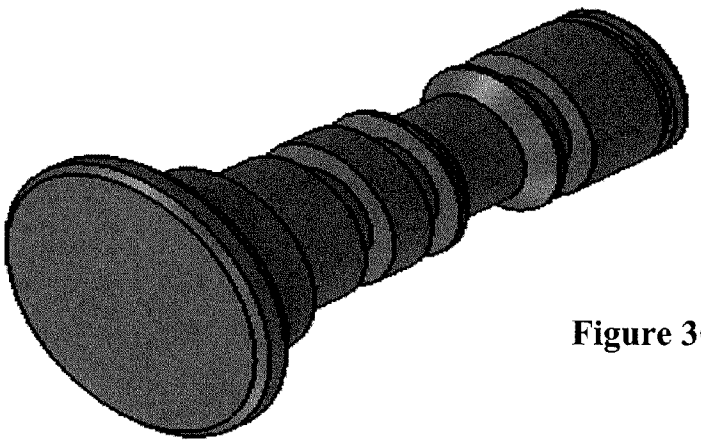

Again referring back to FIG. 2, rack 230 is mounted on block 210 via screws 235. Further, valves 250 are inserted into rack 230. In one embodiment, each of valves 250 controls the flow of fluid from an ink line 114 through a row of receptacles 215 and out through rack 230. Thus, fluid may be removed from ink lines 114 attached to one row of receptacles 215 by opening the associated valve 250, while fluid is prevented from flowing through an adjacent row while its associated valve is closed. FIG. 3C illustrates an isometric view of valve 250.

Figure 3D:
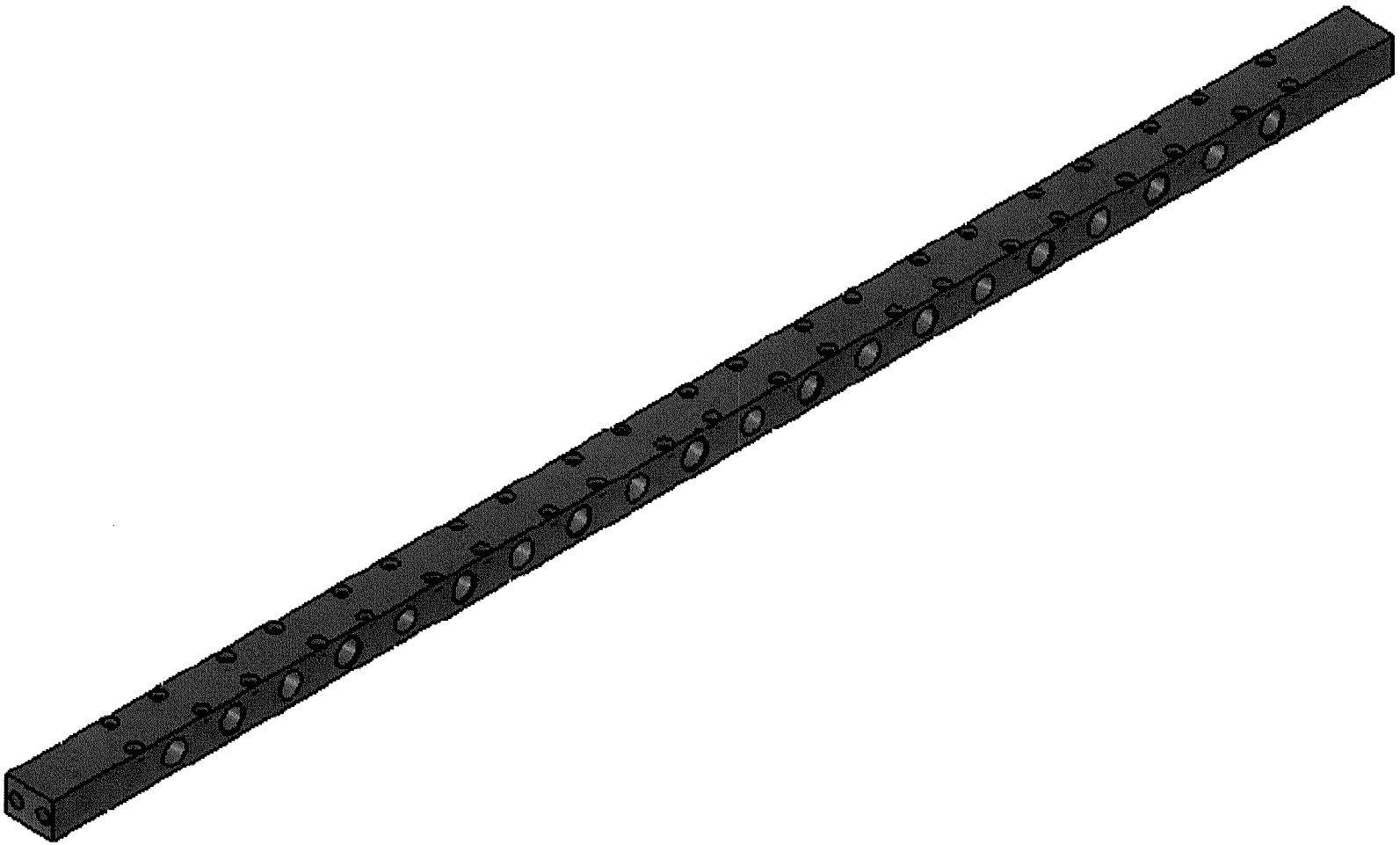

Back to FIG. 2, rack 230 also includes fluid removal ports 240 that discharge fluid from block 210 through hoses 260 to maintenance station 120. Thus, fluid that is removed from each row of ink lines into rack 230 exits manifold 130 via hoses 260. FIG. 3D illustrates an isometric view of rack 230.

The above-described fluid change manifold expedites print engine fluid removal and facilitates single fluid removal, thus eliminating wasted ink. The manifold also eliminates the possibility of damaging a print head during fluid removal since the fluid is not removed via the print heads. Further, manifold 130 allows removal of fluid from the ink supply lines to as few as one print head.

Throughout the foregoing description, for the purposes of explanation, numerous specific details were set forth in order to provide a thorough understanding of the invention. It will be apparent, however, to one skilled in the art that the invention may be practiced without some of these specific details. Accordingly, the scope and spirit of the invention should be judged in terms of the claims which follow.

What is claimed is:

1. A system comprising:
a print engine including:
one or more ink jet print heads; and
ink lines coupled to provide ink to each of the print heads; and
a fluid change manifold coupled to the ink lines to remove fluid from the print engine via the ink lines, including:
a first set of receptacles coupled to a first set of ink lines to remove a first fluid type; and
a second set of receptacles coupled to a second set of ink lines to remove a second fluid type.

2. The system of claim 1 wherein the first fluid type is a first combination of fluids and the second fluid type is a second combination of fluids.

3. The system of claim 1 wherein the first fluid type and the second fluid type are the same.

4. The system of claim 1 wherein the first fluid type comprises a first viscosity and the second fluid type comprises a second viscosity.

5. The system of claim 1 wherein the fluid change manifold further comprises a bracket coupled to a block.

6. The system of claim 1 wherein the ink change manifold further comprises a rack coupled to the block to remove fluid from the fluid change manifold.

7. The system of claim 6 wherein the rack further comprises:
a first valve to receive the first fluid type from the first set of receptacles; and
a second valve to receive the second same or other fluid type from the second set of receptacles.

8. The system of claim 7 wherein the first fluid type is removed from the first set of ink lines while the first valve is open and prevented from being removed while the first valve is closed.

9. The system of claim 7 wherein the second fluid type is removed from the second set of ink lines while the second valve is open and prevented from being removed while the second valves are closed.

10. The system of claim 7 wherein the rack further comprises:
fluid removal ports to remove the fluid from fluid change manifold; and
one or more hoses coupled to the fluid removal ports.

11. The system of claim 10 further comprising a maintenance station coupled to the one or more hoses.

12. The system of claim 11 wherein the maintenance station provides a vacuum to the fluid change manifold to facilitate fluid removal.

13. A fluid change manifold comprising:
a block including:
a first set of receptacles coupled to a first set of ink lines to remove a first fluid type or combination of fluids from a print engine; and
a second set of receptacles coupled to a second set of ink lines to remove the same or other fluid types or combination of fluids from a print engine.

14. The fluid change manifold of claim 13 further comprising a bracket coupled to the block.

15. The ink change manifold of claim 13 further comprising a rack coupled to the block to remove fluid from the fluid change manifold.

16. The fluid change manifold of claim 15 wherein the rack further comprises:
a first valve to receive the first fluid type from the first set of receptacles; and
a second valve to receive the second fluid type from the second set of receptacles.

17. The fluid change manifold of claim 16 wherein the first fluid type is removed from the first set of ink lines while the first valve is open and prevented from being removed while the first valve is closed.

18. The fluid change manifold of claim 16 wherein the second fluid type is removed from the second set of ink lines while the second valve is open and prevented from being removed while the second valve is closed.

19. The fluid change manifold of claim 16 wherein the rack further comprises:
fluid removal ports to remove the fluid from the fluid change manifold; and
one or more hoses coupled to the fluid removal ports.

* * * * *